United States Patent [19]

Johnson

[11] Patent Number: 5,051,875

[45] Date of Patent: Sep. 24, 1991

[54] UNDERWATER POOL LIGHT

[75] Inventor: Bruce R. Johnson, Sebastopol, Calif.

[73] Assignee: KDI American Products, Inc., Moorpark, Calif.

[21] Appl. No.: 531,578

[22] Filed: Jun. 1, 1990

[51] Int. Cl.[5] ..... F21V 33/00; F21V 25/10; F21V 29/00

[52] U.S. Cl. ..... 362/101; 362/267; 362/276; 362/294; 362/263; 362/336; 362/802

[58] Field of Search ..... 362/101, 373, 294, 276, 362/263, 802, 336, 338, 267, 347

[56] References Cited

U.S. PATENT DOCUMENTS

| | | | |
|---|---|---|---|
| 1,764,936 | 6/1930 | Byck | 362/101 |
| 1,792,398 | 2/1931 | Rother | 362/101 |
| 1,806,435 | 5/1931 | Werner | 362/101 |
| 2,906,863 | 4/1954 | Ritter | 362/101 |
| 3,192,379 | 6/1965 | Garmo | 362/101 |
| 3,339,066 | 8/1967 | Hart | 362/101 |
| 3,962,675 | 6/1976 | Rowley et al. | 362/101 |
| 4,156,894 | 5/1979 | Berry | 362/267 |
| 4,216,411 | 8/1980 | Ehret et al. | 362/802 |
| 4,234,819 | 11/1980 | Maxey | 362/276 |
| 4,290,094 | 9/1981 | Jensen | 362/145 |
| 4,433,366 | 2/1984 | Wade | 362/207 |
| 4,458,302 | 7/1984 | Shiba et al. | 362/347 X |
| 4,460,944 | 7/1984 | Gordbegli et al. | 362/276 |
| 4,503,489 | 3/1985 | Duerr et al. | 362/101 |
| 4,543,623 | 9/1985 | Ehret | 362/267 |
| 4,556,933 | 12/1985 | Mendoza | 362/267 |
| 4,574,337 | 3/1986 | Poppenheimer | 362/267 |
| 4,587,599 | 5/1986 | St. Hilaire | 362/101 |
| 4,604,680 | 8/1986 | Levin et al. | 362/347 X |
| 4,617,615 | 10/1986 | Eyehaner | 362/216 |

FOREIGN PATENT DOCUMENTS

| | | | |
|---|---|---|---|
| 539377 | 9/1945 | United Kingdom | 362/338 |

*Primary Examiner*—Ira S. Lazarus
*Assistant Examiner*—Peggy A. Neils
*Attorney, Agent, or Firm*—Noel F. Heal; Lois C. Babcock

[57] ABSTRACT

An underwater pool light that is flush-mounted, versatile, safe, economical, easy to maintain, temperature controlled and liquid cooled, and provides the ability to direct the light in a specified direction. The underwater pool light includes a mounting assembly for attachment to a wall of either a gunite or vinyl liner wall pool; a housing having front and rear faces and removably attached by its rear face to the mounting assembly for ease in repair of the light; a one-piece reflector attached to the housing and used to direct the light out from the housing; a light source placed in front of the one-piece reflector in the housing and mounted in a plane parallel to the pool wall on which the light is mounted; a temperature sensor placed in the housing next to the light source to detect overheating; a lens attached and sealed with a gasket to the front face of the housing and in front of the light source for directing the light and forming a sealed light source cavity; and means for cooling the light by allowing the liquid in the pool to circulate behind the light source cavity.

10 Claims, 4 Drawing Sheets

UNDERWATER POOL LIGHT

BACKGROUND OF THE INVENTION

This invention relates generally to underwater pool lights and, more particularly, to flush mounted pool lights. Such lights are used in swimming pools, wading pools, fountains and spas.

Underwater pool lights generally require a niche in a wall of the pool for installation of the light. This requires extra excavation and concrete reinforcing or "rebar" work, as well as extra gunite to install the light in a gunite pool. Most underwater lights are, therefore, bulky and expensive to install. In vinyl liner pools additional reinforcing is usually required, and large holes, nine to twelve inches wide, are needed to install wet niche lights. This type of installation also increases the chance of leaks in vinyl liner pools. Many available lights simply cannot be used in vinyl liner pools.

Some underwater lights must be removed and completely disassembled just to replace a bulb, adding to their inconvenience and requiring experienced personnel for maintenance. Other lights have no heat sensing device to detect overheating, therefore reducing bulb life and increasing maintenance costs.

Some underwater lights use clear covers or lenses and provide no directional control over the light output. These lights have a tendency to illuminate not just the pool but also the surrounding area. The resulting glare is both an inconvenience and a safety hazard. Fountain lights also need to be appropriately directed to avoid unwanted glare. Another requirement for underwater lights is an effective reflector to direct light out into the pool.

It will be appreciated from the foregoing that there has long been a need for improvement in the field of underwater pool lights. In particular, there has been a need for an underwater pool light that is flush mounted, can be used in either a gunite or vinyl liner pool, provides for ease of maintenance and safety, and directs the light in a specified direction. The present invention satisfies this need.

SUMMARY OF THE INVENTION

The present invention resides in an underwater pool light with a novel combination of a mounting assembly, a housing, a reflector, a light source, a temperature sensor, a lens, and means for cooling the light source. Briefly, and in general terms, the invention includes a mounting assembly that fits flush with a wall of the pool, a housing having front and rear faces and removably attached by its rear face to the mounting assembly, a one-piece reflector attached to the housing, a light source positioned in the housing and in front of the one-piece reflector, a temperature sensor positioned in the housing and adjacent to the light source, a lens attached and sealed with a gasket to the housing in front of the light source, and means for cooling the light source by allowing liquid in the pool to flow through and behind the housing.

More specifically, the mounting assembly includes means for attachment either to a gunite pool wall or to a vinyl liner pool wall, for a more versatile pool light.

The housing provides a power cord storage area between the sealed light source cavity and the mounting assembly. This cord storage area facilitates repair and maintenance at a distance from the installation site, limited only by the length of the cord in the storage area.

The housing also contains the one-piece reflector, which is preferably hyperbolic in shape. The reflector is used in conjunction with the lens to direct the light both out from the fixture and in a specified direction, such as vertically down into the pool.

The light source is a double-ended quartz halogen lamp mounted in a plane parallel to the plane of the pool wall on which the light is mounted. This facilitates flush-mounting of the light fixture, since halogen lamps are typically small in diameter but relatively long.

The means for cooling the light source includes openings that allow the liquid in the pool to circulate behind the housing. The liquid flows through these openings, which are located outside the sealed light source cavity, behind the cavity. Since the housing is spaced from the pool wall by the mounting assembly, the liquid can also flow around the outer circumference of the housing.

The lens is designed to direct the light in a specified direction. It has a plurality of contiguous parallel concave lens elements extending in a selected direction across one surface of the lens for dispersing the light perpendicular to the first direction. An array of additional lens elements formed integrally with the lens surface and spaced apart on the surface are designed to disperse light predominantly in another selected direction.

The means for attachment to a gunite pool wall has a front and rear face, a plurality of tabs for holding the means for attaching the housing in place, a power cord passageway allowing the cord to pass from the rear face to the front face, and means for removably attaching the housing to the means for attachment to the gunite pool.

The means for attachment to a vinyl liner pool includes a flange mounting attached to the outside of the pool wall and for securing a conduit, allowing the power cord to pass through the pool wall, a mounting hub positioned between the pool wall and the vinyl liner and attached to the flange mounting, and means for removably attaching the housing to the means for attachment to the gunite pool.

It will be appreciated from the foregoing that the present invention represents a significant advance in the field of underwater pool lights. In particular the invention provides an underwater pool light that mounts flush with an existing pool wall, of either a gunite or vinyl liner pool. No excavation or "rebar" work is required to install the light in gunite pools, and the light is easy to maintain, less likely to leak than other lights, and provides light in a desired direction. Other aspects and advantages of the invention will become apparent from the following more detailed description, taken in conjunction with the accompanying drawings.

DESCRIPTION OF THE PREFERRED EMBODIMENT

Figure 1:
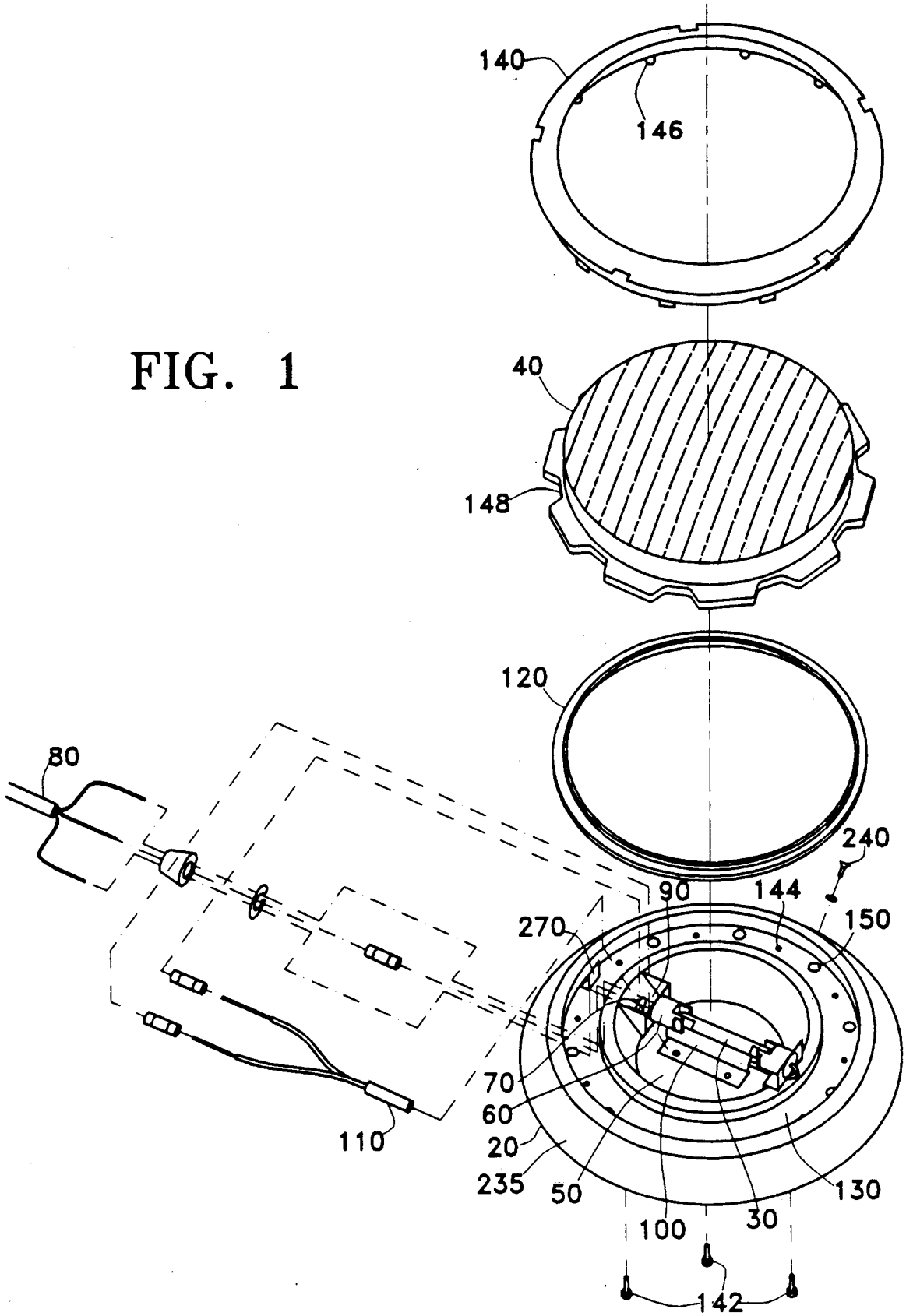
FIG. 1 is an exploded perspective view of the underwater pool light embodying the invention.

As shown in the drawings for purposes of illustration the present invention is concerned with improvements in the field of underwater pool lights. Prior to this invention, underwater pool lights usually required a niche to be formed in the wall of the pool to house the light and allow liquid to circulate behind it for cooling. This type of installation prevented many pool lights from being versatile enough to be used in both gunite and vinyl liner pools, and was more susceptible to leaks. These underwater pool lights are usually bulky, difficult to repair, and relatively expensive.

Figure 2:
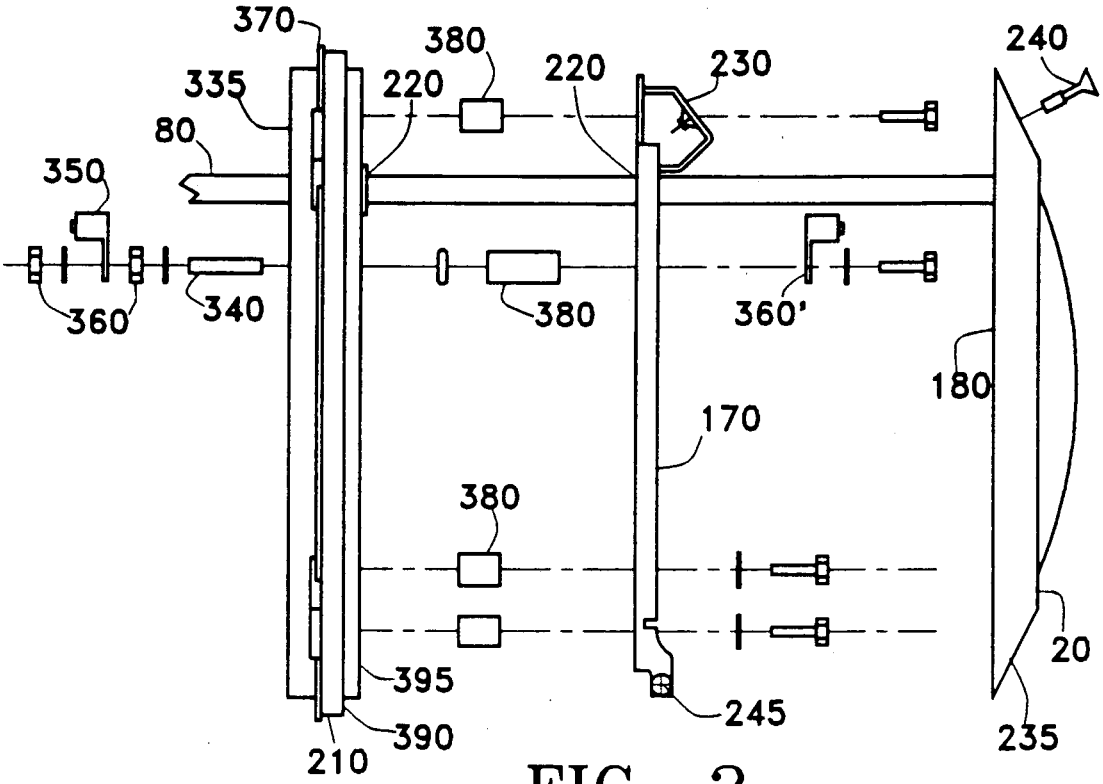
FIG. 2 is an exploded elevational view of the underwater pool light, showing the mounting bracket for a gunite pool wall.
Figure 4:
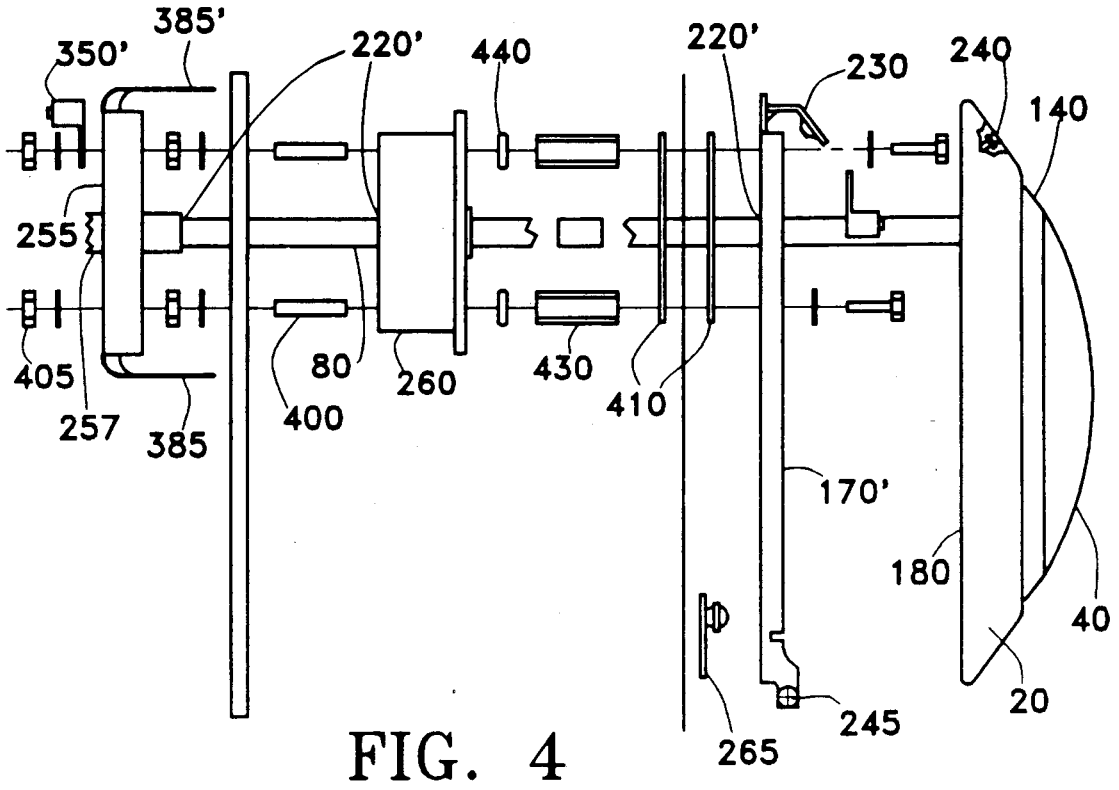
FIG. 4 is an exploded elevational view of the underwater pool light, showing the mounting bracket for a vinyl liner pool.

In accordance with the present invention, an underwater pool light includes a mounting assembly 10 or 10' for attaching the underwater pool light flush with a wall of a pool as shown in FIG. 2 or FIG. 4, a housing 20 having front and rear faces removably attached to the mounting assembly 10 or 10', a double-ended halogen bulb 30 placed in the housing, and a lens 40 sealably attached to the housing.

More specifically, a s shown in FIG. the housing 20 includes a light source cavity 50 located at its center and recessed to accommodate the halogen bulb 30 in a spring-loaded socket 60 placed at the center of the light source cavity, an opening 70 for a power cord 80 connected to the socket 60, power circuitry 90 encapsulated in resin, a one-piece hyperbolic shaped reflector 100 located adjacent to the halogen bulb 30 for directing the light out of the fixture in a specified direction, and a temperature sensor 110 connected to the power circuitry 90 for disconnecting the light when it overheats. The sensor is located adjacent to the one-piece reflector 100 and opposite the halogen bulb 30. The light source cavity 50 is made water tight when the lens 40 is sealed with a gasket 120 against a channel 130 formed by the housing 20 and is held securely in place by a face ring 140 screwed to the housing 20.

In the presently preferred embodiment of the invention, the face ring 140 is secured to the housing 20 by screws, three of which are shown at 142, positioned in holes 144 in the body, and engaging threaded holes (not shown) in integral bosses 146 depending from the face ring's inner face. Tightening the screws 142 secures the face ring 140 to the housing 20, and also secures the lens 40 and gasket 120. The lens 40 has notches 148 around its circumference to accommodate the screws 142, and the bosses 146 on the face ring 140 serve to keep the channel 130 free for the passage of cooling pool water.

Liquid in the pool flows behind the light source cavity 50 for cooling the halogen bulb 30, through openings 150 in the channel 130 formed by the housing 20, located outside and surrounding the light source cavity 50 and around the perimeter of the housing 20 which is spaced from the pool wall by a bracket 170.

A cord storage area 180 facilitates repair and maintenance of the fixture, and is located behind the rear face of the housing 20 and between the light source cavity 50 and the perimeter of the housing. The light source cavity 50 has a raised cylindrical wall 185 perpendicular to the rear face of the housing 20, around its outer edge, to help retain the power cord 80.

Figure 5:
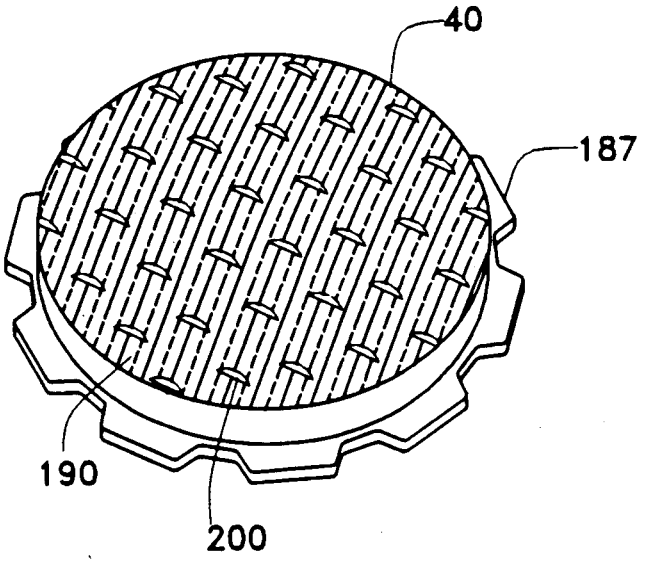
FIG. 5 is a perspective view of the underwater pool light lens.
Figure 6:
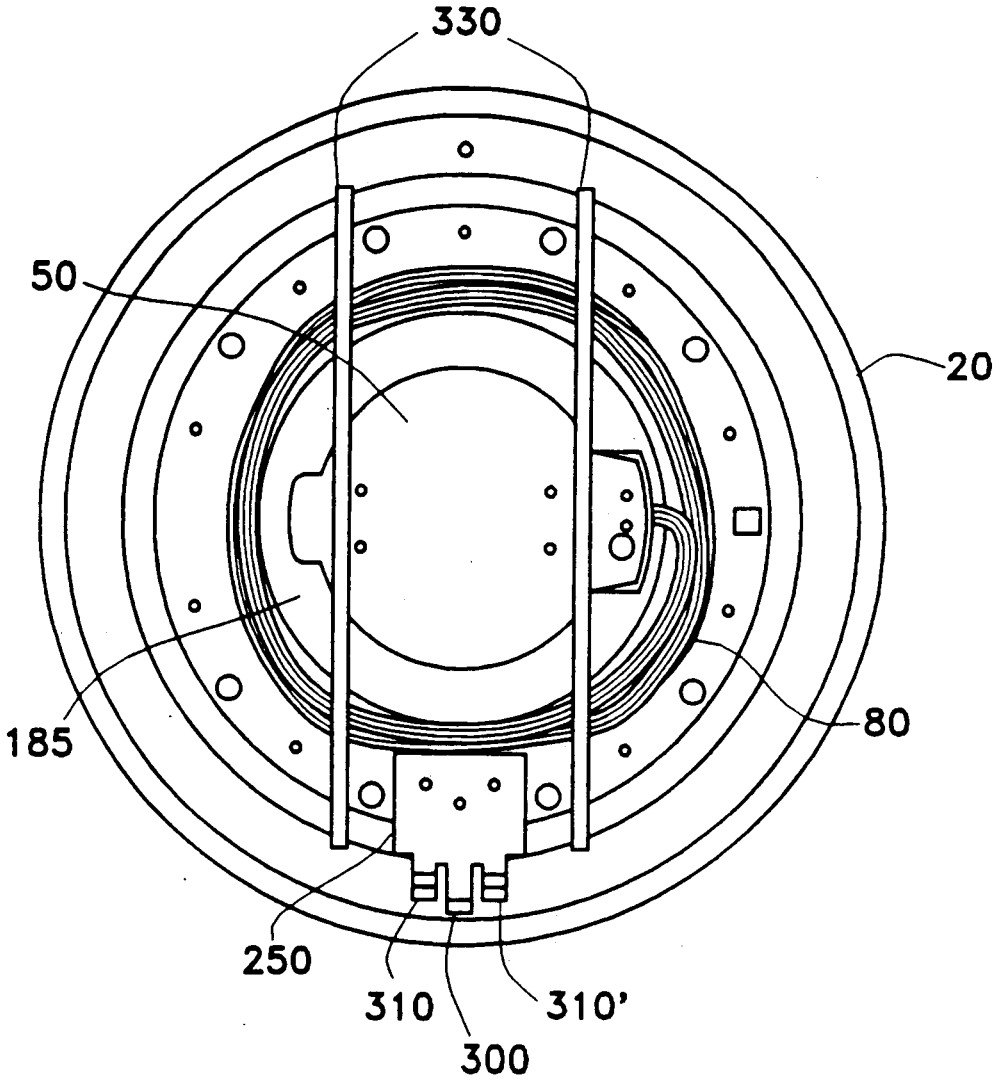
FIG. 6 is a perspective view of the rear face of the underwater pool light housing.

The lens 40 as shown in FIG. 5 has a front and rear face with the front face being convex in shape and the perimeter being positioned in a plane parallel to the pool wall. The lens 40 has an integral notched rim extending circumferentially about the lens, and radially from its center. The notched rim 187 is used to secure lens 40 to the housing 20. The rear face of the lens 40 has a plurality of contiguous parallel cylindrical concave lens elements 190 extending in a selected direction, which is typically vertical for dispersing the light perpendicular to the selected direction. Usually, in a swimming pool or spa, these lens elements have the effect of fanning the light out horizontally. The lens 40 also has an array of additional lens elements 200 formed integrally with and spaced apart on the plurality of contiguous parallel cylindrical concave lens elements 190, to direct the light in a selected direction, usually vertically down into the pool. These additional lens elements 200 are tapered in height above the rear surface of the lens 40. They are convex, and truncated by a flat surface perpendicular to the lens surface. This array of additional lens elements 200 is designed to disperse light predominantly in one selected direction such as down and away from the pool surface.

The mounting assembly 10 as shown in FIG. 2 is used to mount the underwater pool light flush with a wall of a gunite pool and includes a circular, flat plastic plate 210 having front and rear faces, held to the pool wall around an opening for the power cord 80 by plaster, providing a passageway 220 for the power cord 80, and fitting with its rear face flush with the pool wall. The bracket 170 is screwed to the front face of the plate 210, for attaching the light housing 20. The bracket 170 is a flat strip of metal and has an appropriate opening aligned to form part of the power cord passageway 220, and an integral tab 230 at one end angled to match the angle of a housing rim 235, for receiving a pilot screw 240. On the opposite end of the bracket 170 is a pin 245 mounted in a plane parallel with the pool wall between two integral tabs, the pin being positioned to receive a tabbed clip 250 mounted on the rear face of the housing 20.

The mounting assembly 10' is used to mount the underwater pool light flush with a wall of a vinyl liner pool and has a mounting flange 255 mounted against the outside of the pool wall around an opening for the power cord 80 providing support for a conduit 257, a hub 260 located between the pool wall and the vinyl liner for providing a continuous passageway 220' for the power cord 80, and a bracket 170' for attaching the housing 20 on the inside of the vinyl liner. The bracket 170' for the vinyl liner pool is identical to the bracket 170 used for the gunite pool with the exception that there is a rubber stop 265 on the side of the bracket 170' next to the vinyl liner, on the pin 245 end of the bracket 170' to prevent possible damage to the liner.

The removable housing 20 is shaped to fit the circular plate 210, and is made in one piece. Around the outer edge of the light source cavity 50, the housing 20 forms a raised lip with the solid flat edge of the channel 130 adjacent this lip receiving the gasket 120 next to the housing 20 and then the lens 40 to help form a water tight seal. Integral with the housing channel 130, adjacent to the power circuitry 90, and between two openings 150, there is a flat tab 270 perpendicular to the front face of the housing 20 that fits the notched rim 187 of the lens 40 to prevent the lens 40 from rotating. The housing 20 extends beyond the channel 130 and is angled toward the rear face of the housing. This housing rim 235 acts as a standoff from the pool wall when the housing 20 is mounted on the bracket 170 and provides a hole for the pilot screw 240 which screws into a tab 230 on the bracket 170.

The tabbed clip 250 is attached at one end to the rear face of the housing channel 130, and diametrically opposite the pilot screw 240, having an angular portion parallel to the housing rim 235 and having three integral tabs on the end of the angular portion for the removable attachment of the housing 20 to the bracket 170. A center tab 300 extends in a direction parallel to the housing while tabs 310 and 310' on either side of the center tab 300 are crimped toward the pool wall to fit over the pin 245 on the bracket 170. When the housing 20 is to be mounted on the bracket 170, the two outer tabs 310 and 310' are placed on one side of the pin 245 and the center tab 300 is placed on the opposite side of the pin 245. As force is applied to the housing 20, in a direction toward the pin 245 the tabs 300, 310, and 310' flex away from the pin 245 and allow it to be held securely in the crimped portion of tabs 310 and 310'. With the housing in this position the pilot screw 240 is threaded through the angled housing rim 235 and into the angled tab 230 on the opposite end of the bracket 170, to hold the housing 20 securely to the plate 210.

Two parallel rods 330 are attached to the rear face of the light source cavity 50 and extend almost to the edge of the housing 20, leaving sufficient clearance for the power cord 80 to be wound around the cylindrical wall 185 and under the rods 330. These rods 330 hold the power cord 80 in place.

Figure 3:
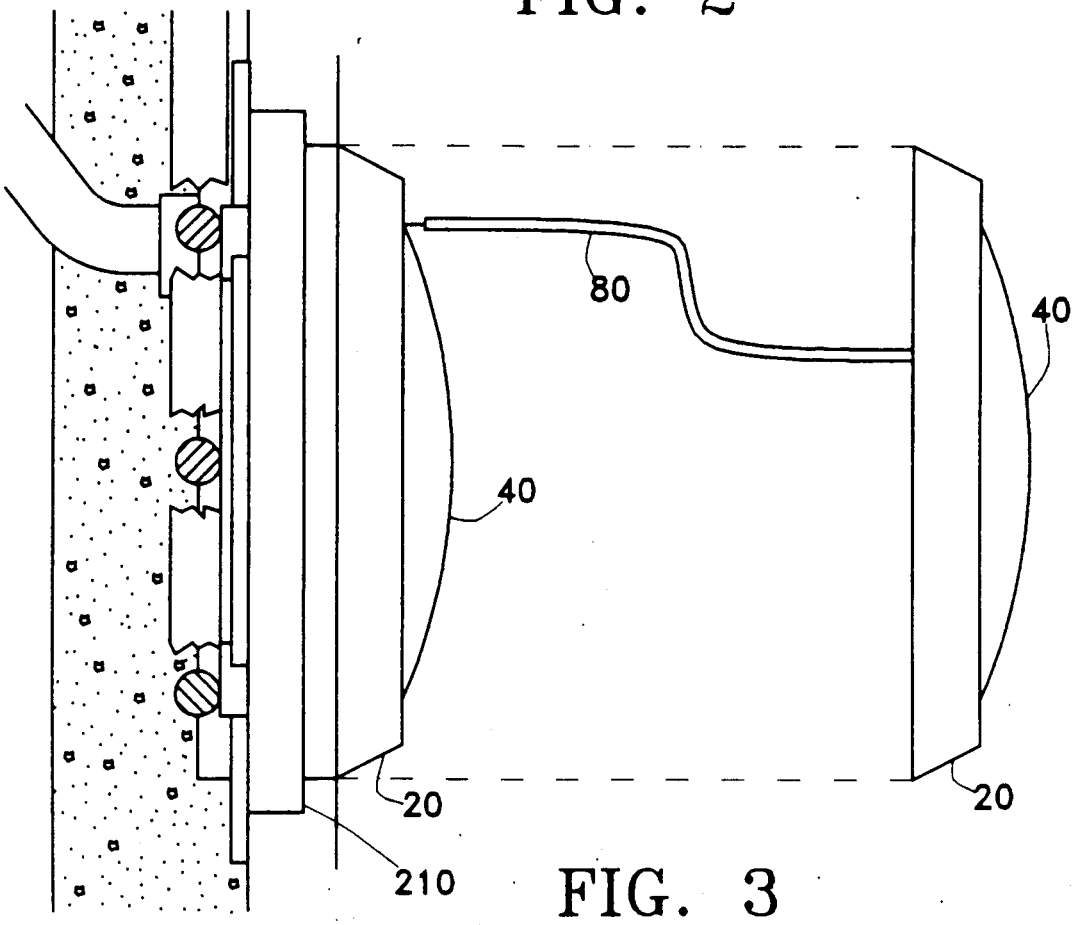
FIG. 3 is another elevational view of the underwater pool light showing the light mounted on a gunite pool wall, with a superimposed image of the light removed for repair.

The rear face of the plate 210 for attachment to a gunite pool has a concentric cylindrical wall 335 with a slightly smaller diameter than the plate 210, the wall extending toward the pool wall. Located next to the power cord passageway 220 on the rear face of the plate 210 is a threaded stud 340 to which a copper grounding lug 350 is attached by a nut 360. The plate 210 is held in place for plastering by four spaced apart integral nailing tabs 370 located around the perimeter of the plate 210. On the front face of the plate 210, and formed integrally with it, are six blind threaded standoffs 380 for receiving screws to hold the bracket 170. Four of these standoffs 380 are located around the power cord passageway 220 with one used also for attaching a copper grounding lug 360'. Integral with the front face of the plate 210 are two concentric cylindrical walls 390 and 395, the outer one 390 being plastered over to help anchor the plate 210 when the plaster dries, and the inner wall 395 being flush with the surface of the pool plaster as shown in FIG. 3.

The mounting flange 255 for attachment of the underwater pool light to the vinyl liner pool includes a rectangular metal strip larger than the power cord passageway 220' with tabs 385 and 385' at the narrow ends of the rectangular shape that are perpendicular to the metal strip spacing the mounting flange 255 away from the pool wall. The mounting flange 255 is mounted on the outside of the pool wall, with the conduit in the power cord passageway 220', and is held in place by two nuts 405 located on two threaded bolts 400 which extend outside the pool wall from the hub 260. Mounted on one of the threaded bolts 400 and at the flange surface on the side opposite the pool wall is a copper grounding lug 350'. The mounting hub 260 is basically cylindrical in shape, having a rounded lip on one end, next to the vinyl liner, fitting flush with the pool wall, and with the passageway 220' for the power cord 80 being formed through the center of the hub. The mounting hub 260 has two hexagonal recesses on its surface against the vinyl liner, around the passageway 220' and diametrically opposite each other, for receiving the threaded bolts 400 that attach the mounting flange 255. On either side of the vinyl liner and around the power cord passageway 220' are two gaskets 410 to provide a water tight seal. On the inside of the vinyl liner and around the power cord passageway 220' is the bracket 170'. The bracket 170' is held in place by four screws 420, which pass through the bracket 170' and the two gaskets 410, engaging threaded blind holes 430 in the mounting hub 260 to provide a water tight seal. Two of the threaded blind holes 430 are integral with the heads of the threaded bolts 400 and are sealed against the hub 260 with washers 440.

It will be appreciated from the foregoing that the present invention represents a significant advance in the field of underwater pool lights. In particular, the invention provides for a flush mounted, versatile, safe, easy to maintain, temperature controlled, liquid cooled, light directed underwater pool light. It will also be appreciated that, although a specific embodiment of the invention has been described in detail for purposes of illustration, various modifications may be made without departing from the spirit and scope of the invention. Accordingly, the invention is not to be limited except as by the appended claims.

I claim:

1. An underwater light comprising:

a mounting assembly that fits flush with a wall of a water pool for attaching the underwater light without having to make a niche in the wall;

a housing having front and rear faces and removably attached by its rear face to the mounting assembly, to facilitate repair and maintenance of the light, and having a generally cylindrical internal wall that defines, in part, a light source cavity;

a one-piece reflector attached to the housing and used to direct light out from the housing;

a light source placed in front of the one-piece reflector in the housing;

a temperature sensor placed in the housing next to the light source to detect overheating;

a lens sealably attached to the front face of the housing and in front of the light source for directing the light and sealing the light source cavity; and means for cooling the light source by allowing the liquid in the pool to circulate behind the light source cavity through openings in the housing, and around the circumference of the housing, which is spaced from the pool wall by the mounting assembly;

and wherein the housing contains a power cord storage area surrounding the generally cylindrical internal wall that defines the light source cavity, to facilitate removal of the housing for repair and maintenance at a remote location without disconnection of the power cord, and without having to provide a wall niche for cord storage.

2. An underwater light as defined in claim 1, wherein: the mounting assembly includes means for attachment to a gunite pool wall.

3. An underwater light as defined in claim 1, wherein: the mounting assembly includes means for attachment to a vinyl liner pool wall.

4. An underwater light as defined in claim 1, wherein:

the one-piece reflector is hyperbolic in shape.

5. An underwater light as defined in claim 1, wherein:

the lens has a plurality of contiguous parallel concave lens elements extending in a first direction across one surface of the lens for dispersing the light perpendicular to the first direction, and an array of additional lens elements formed integrally with the lens surface and designed to disperse light predominantly in one selected direction.

6. An underwater light as defined in claim 5, wherein:

the array of additional lens elements are spaced apart on the lens surface.

7. An underwater light as defined in claim 5, wherein:

the light source is a double-ended quartz halogen bulb.

8. An underwater light as defined in claim 7, wherein:

the halogen lamp is mounted in a place parallel to the plane of the pool wall on which the light is mounted.

9. An underwater light as defined in claim 1, wherein:

the mounting assembly includes means for attachment to a gunite pool wall; and the means for attachment to a gunite pool wall has a front and rear face, a plurality of tabs for holding the means for attachment in place and acting as a plaster ring when applying gunite to the pool, a power cord passageway passing from the rear to the front of the means for attachment, and means for removably attached the housing to the means for attachment to the gunite pool.

10. An underwater light as defined in claim 1, wherein the mounting assembly includes:

means for attachment to a vinyl liner pool, including a flange mounting attached to the outside of the pool wall, for securing the mounting assembly and allowing a power cord to pass to the inside of the pool wall, and a mounting hub positioned between the pool wall and the vinyl liner and attached to the flange mounting, allowing the power cord to pass to the inside of the pool; and means for removably attaching the housing to the means for attachment to a vinyl liner pool.

* * * * *